United States Patent [19]

Koutonen

[11] Patent Number: 4,723,395

[45] Date of Patent: Feb. 9, 1988

[54] APPARATUS FOR WRAPPING PAPER ROLLS AND THE LIKE IN A WRAPPER

[75] Inventor: Pauli Koutonen, Jokela, Finland

[73] Assignee: Oy Wärtsilä Ab, Helsinki, Finland

[21] Appl. No.: 867,558

[22] Filed: May 28, 1986

[30] Foreign Application Priority Data

May 29, 1985 [FI] Finland ..... 852151

[51] Int. Cl.[4] ..... B65B 11/04

[52] U.S. Cl. ..... 53/587; 53/211

[58] Field of Search ..... 53/587, 211, 215

[56] References Cited

U.S. PATENT DOCUMENTS 1,769,081 6/1930 Jones ..... 53/211 X 3,851,443 12/1974 Fine ..... 53/587 X 4,224,782 9/1980 Moflag ..... 53/587

*Primary Examiner*—John Sipos

*Attorney, Agent, or Firm*—Birch, Stewart, Kolasch, & Birch

[57] ABSTRACT

An apparatus for wrapping different sizes of paper rolls or rolls of like material into a wrapper by rotating the rolls. The apparatus comprises a support frame encompassing the roll, means for conveying the wrapper on the roll, and at least one flexible guide band which is devised to press on the outer surface of the roll and to comply with the rotating of the roll. In the apparatus according to the invention, the guide band is configured into an endless conveyor with an at least approximately U-shaped form, within which the roll to be wrapped is inserted. An inner loop of the conveyor is configured to pass over four guide rollers mounted on two first lever arms and two second lever arms are capable of being transferred against the outer surface of the roll to be wrapped. Then, the guide band, which passes over the guide rollers, during the wrapping phase touches the surface of the roll to be wrapped at each point within the three circumferential segments between the guide rollers on the outer surface of the roll to be wrapped.

8 Claims, 3 Drawing Figures

APPARATUS FOR WRAPPING PAPER ROLLS AND THE LIKE IN A WRAPPER

The present invention relates to an apparatus for wrapping large paper rolls and the like in a wrapper.

Machines for wrapping paper rolls and the like known in the prior art suffer from problems in folding the end of the wrapper material around the roll so that the wrapper would not wrinkled nor would separate from the roll. This drawback causes frequent interruptions on the roll wrapping line. The attempts to solve the problem by preparing the wrapper with a glue layer before the wrapping operation, however, lead to difficulties because the accumulations of dried glue debris in the equipment may cause splashing of the glue, which soils the environment. Due to the high volumes of glue consumed, the method becomes expensive and requires constant supervision. In addition, the possible loose layers on the roll hinder the attachment of the first wrapper layer on the roll, thus resulting to an incomplete solution to the problem. On the other hand, solutions to the problem have been sought by locating at different sides of the roll to be wrapped several short guide bands, which convey the wrapper for a short distance. These solutions often prove to be complicated as well as expensive with such an additional problem in guiding the wrapper that the short bands are incapable of closely complying with the surface of the roll especially when the roll sizes vary.

The FI patent publication No. 57564 presents a solution, in which the support frame houses a bidirectionally movable drive apparatus and a circulating guide band for the wrapper so that in its home position the drive apparatus is designed to support a part of the guide band. Thus, the guide band is deflected away from the roll to be wrapped and cannot fold on the roll. To convey the wrapper end around the roll, the drive apparatus is designed movable so that the deflection point of the guide band is shifted as far as possible around the roll to be wrapped. Consequently, a part of the guide band is folded over the free outer surface of the roll so that the entered wrapper remains between the guide band and the roll when the roll is rotated.

Even the aforementioned solution suffers from the drawback of a rather complicated construction.

The aim of the invention is to provide a simpler and more reliable wrapping apparatus than those of prior art techniques.

The apparatus according to the invention is based on configuring the guide bands to follow the outer surface of the roll as an approximately U-shaped endless conveyor, which is pressed by movable conveyor rollers mounted on lever arms so that the bands are in continuous contact with the outer surface of the roll over a large area.

The invention offers appreciable advantages. Thanks to the uncomplicated lever construction, the guide band is quickly and reliably applied on the outer surface of the roll to be wrapped. Because the use of basic actuator components such as pneumatic cylinders is possible, the control of lever arms and guide bands as well as the control of power and speed is easy.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
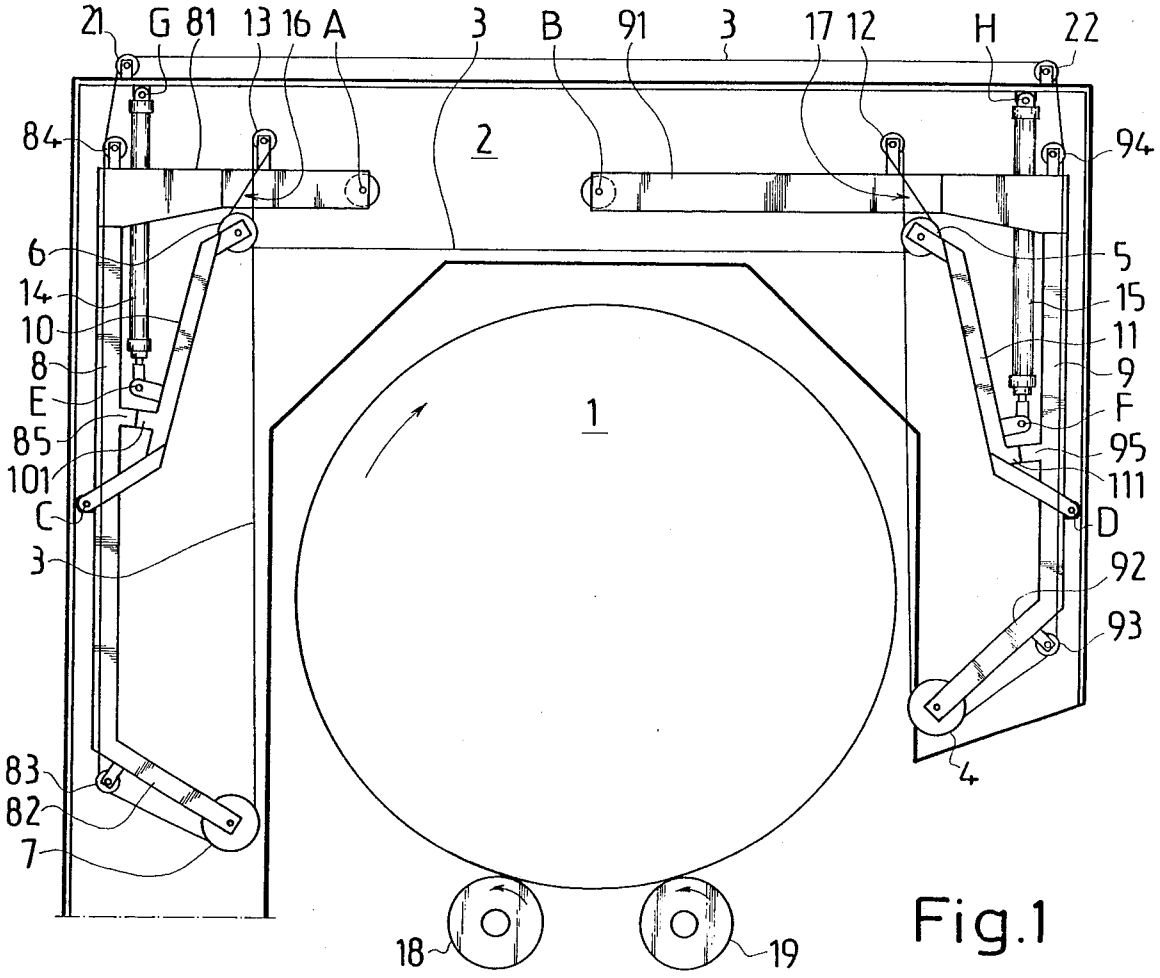
FIG. 1 shows one embodiment of the apparatus in accordance with the invention viewed in the axial direction of the roll when the guide bands are still separated from the roll to be wrapped.

The reference number 1 in the drawing refers to the roll to be wrapped, which is transferred to the wrapping station by a conveyor that is not visible. During the wrapping operation, a roll 1 is supported by rotatable support rollers 18, 19. The wrapping apparatus also comprises support frame 2 and a feeder band, not shown in the drawing, for entering the wrapper.

When the roll 1 is transferred to the wrapping station by a conveyor, the conveyor is lowered to transfer the roll 1 on the support rollers 18 and 19. The wrapper is entered by the aforementioned feeder band. The wrapper roll proper and its actuators are not shown because these components are provided by constructions of the prior art.

In the initial condition of FIG. 1, the roll 1 of large diameter is supported by the rotatable support rollers 18 and 19. Resilient, endless guide bands 3, of which one or several can be applied, are configured to comply in an approximately U-shaped form from three sides with the outer surface of the roll 1. The inner loop 4–5–6–7 of the band is configured to pass over the four guide rollers 4 . . . 7, which are situated so that when seen from the end of the roll 1 they are located at the corners of a quadrangle surrounding the circumference of the roll 1. The guide rollers 4 . . . 7 are mounted at the ends of two first lever arms 8, 9 and at the ends of two second lever arms 10, 11, to be applied on the outer surface of the roll 1 to be wrapped. The two first lever arms 8, 9 are mounted pivotable at points A, B on a support frame 2, and, respectively, the two second lever arms 10, 11 are mounted pivotable at points C, D on the first lever arms 8, 9 at an intermediate point between the ends of the lever arms.

The movement of lever arms 8 . . . 11 is achieved by pneumatic cylinders 14, 15, which are mounted as actuators between the support frame 2 and the second lever arms 10, 11.

Figure 2:
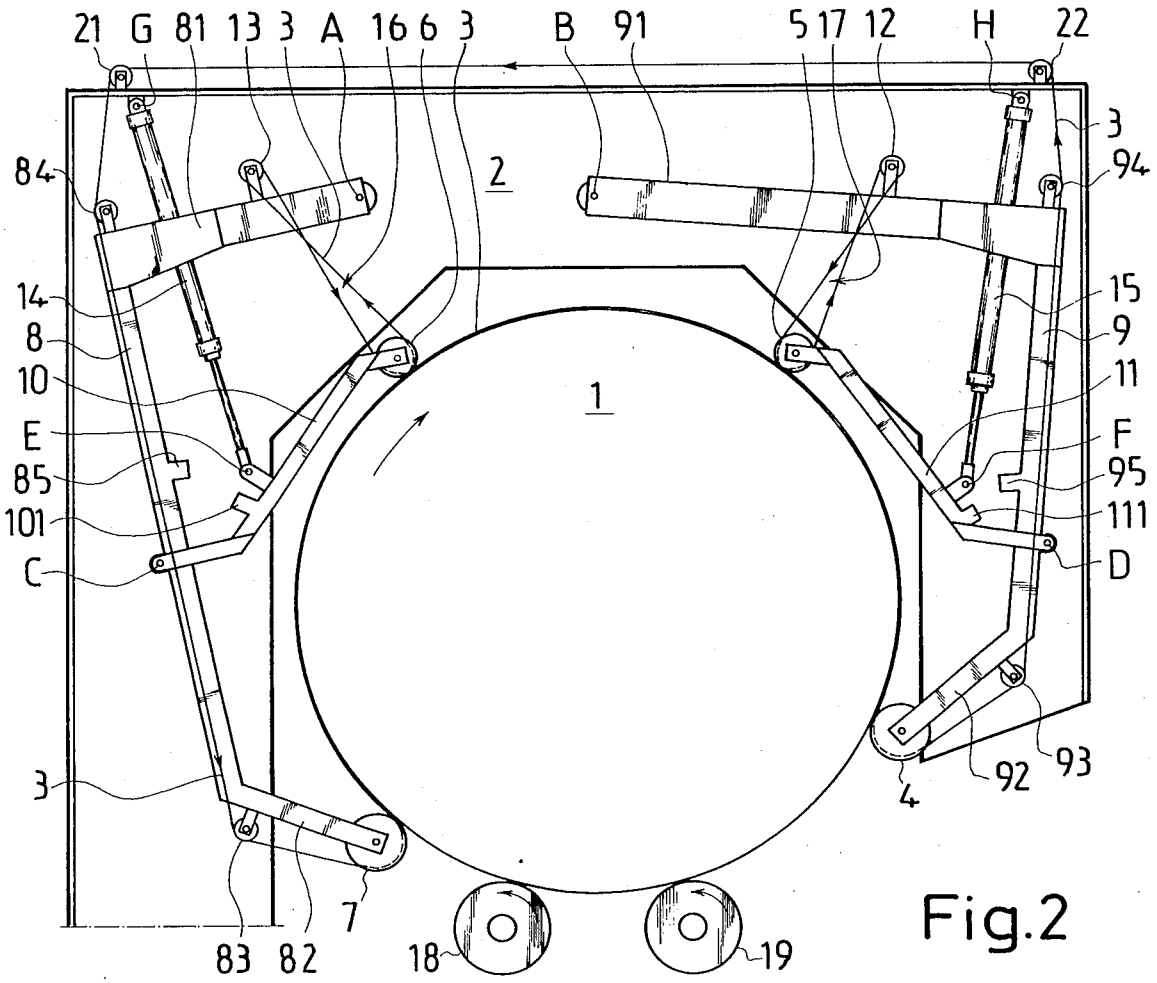
FIG. 2 shows the apparatus in accordance with FIG. 1 when the guide bands are pressed against the outer surface of the roll.
Figure 3:
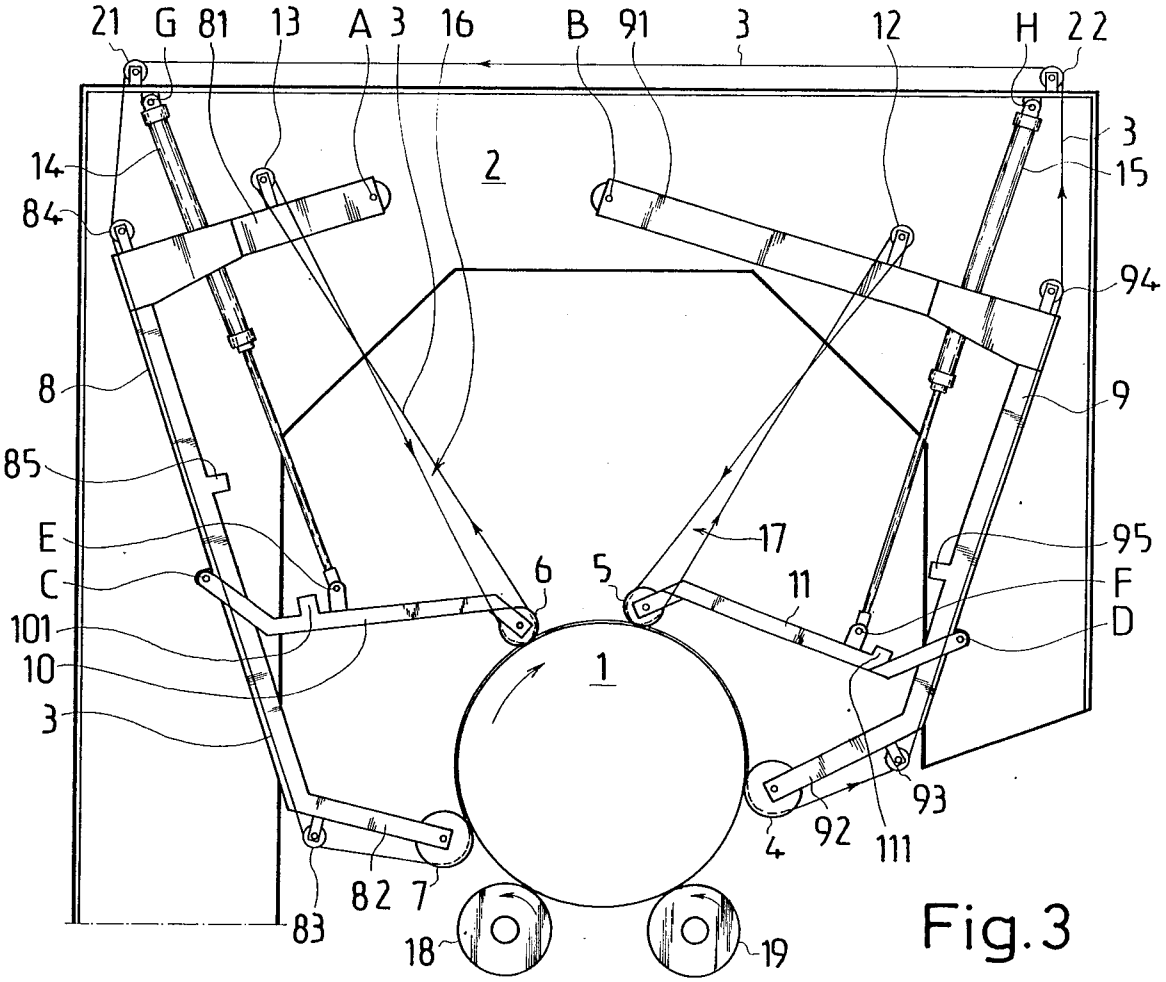
FIG. 3 shows an analogous condition with FIG. 2 except that the roll to be wrapped has an appreciably smaller diameter than that of FIG. 2.

A guide band 3, which passes over guide rollers 4 . . . 7, presses during the wrapping operation (FIGS. 2 and 3), the wrapper paper or foil, which applied on the roll 1 to be wrapped, at each point within the three-part circumferential segments 4–5, 5–6 and 6–7 of the guide rollers 4 . . . 7 on the roll 1 to be wrapped.

To compensate for the shortening of the inner loop 4–5–6–7, compensation rollers 13, 12 are attached near the pivoting points A, B of the first lever arms, complementing the guide rollers 6 and 5 at the ends of the second lever arms 10 and 11. The guide band 3, which first passes over the guide rollers 6, 5 at the end of each second lever arm 10, 11, is configured to pass over the compensation rollers 13, 12 so that between these and the corresponding guide rollers 6, 5 there are formed band loops 16, 17, whose length is dependent on the magnitude of the mutual rotation angle between the first lever arms 8, 9 and the second lever arms 10, 11.

The outer loop of guide band 3 passes over guide rollers 83, 84, and 94, 93 of the first lever arms 8 and 9 as well as over guide rollers 21 and 22 in the support frame 2.

By the effect of pneumatic cylinder actuators 14, 15, the first lever arms 8, 9, and the second lever arms 10, 11 start turning toward the outer surface of the roll 1 while the band loops 16 and 17 between the guide rollers 6 and 13, and 5 and 12, respectively, are lengthened, thus compensating for the shortening of the inner loop 4–5–6–7. If the roll 1 to be wrapped has a small diameter according to FIG. 3, the loops 16 and 17 will become rather long. The guide rollers shown for this embodiment are located so that when the guide band 3 is in the initial position of FIG. 1, its length is shortest. Consequently, this construction maintains the flexibility of the guide band 3 and lengthens its life. Furthermore, the guide band 3 is securely held around the roll 1.

In the exemplifying embodiment, the first lever arms 8 and 9 are provided with transverse members 91 and 81 respectively, which extend up to the pivoting points A and B, and with transverse members 82 and 92, respectively, which extend up to the guide rollers 7 and 4. The first lever arms 8 and 9 are provided with stops 85 and 95 that abut against the corresponding stops 101 and 111, respectively, of the other lever arms 10 and 11.

When a sufficient number of turns of the wrapper has been wrapped around the roll 1, the wrapper feeding is stopped, the wrapper is cut, and its trailing end is coated with glue to attach the end. Then, rolling of the roll 1 is stopped, the lower part of the conveyor roll assembly is lifted to a transportation position, and the roll 1 is transferred from the wrapping station for further processing.

In practice, the diameter of the roll 1 to be wrapped can vary approximately within the range of 600 . . . 1800 mm. A prerequisite for using the same apparatus for different sizes of roll 1 is that the support frame 2 is of sufficient size, and the length compensation of the guide band 3 is designed so that the guide band 3 can be lowered sufficiently tight over the roll 1, irrespective of the diameter of the roll 1. The additional length compensation of the guide band 3 is effected by the stretching of the guide band 1. By using, for instance, polyester-fiber-reinforced rubber band material for the guide band 1, an extremely flexible and endurable construction can be achieved.

The invention of thus being described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for wrapping rolls, said apparatus comprising:

means for rotatably supporting a roll;

a frame;

two first lever arms each pivotably mounted at a first end to said frame;

a first pair of guide rollers each mounted at a second end of each first lever arm;

two second lever arms each pivotably mounted at a first end to each first lever arm at a position between the ends of each first lever arm;

a second pair of guide rollers each mounted at a second end of each second lever arm;

a pair of actuators each pivotably mounted at a first end to said frame and pivotably mounted at a second end to each second lever arm at a position between the ends of each second lever arm;

at least one flexible guide band supported for movement by said first and second pairs of guide rollers in a substantially U-shaped configuration for pressing on the outer surface of the roll and for complying with the rolling movement of the roll, and compensating means for cooperating with said flexible guide band for maintaining tension and for maintaining contact of said flexible guide band with the roll to compensate for different size rolls, said compensating means includes a pair of additional guide rollers each mounted on each first lever arm with said flexible guide band forming a pair of loops, each loop extending between one of said second pair of guides rollers and one of said additional guide rollers of the same lever arm subunit.

2. The apparatus according to claim 1, wherein each first lever arm is substantially L-shaped.

3. The apparatus according to claim 2, wherein said substantially L-shaped first lever arms are positioned to surround the roll in a substantially U-shaped configuration.

4. The apparatus according to claim 2, wherein said lever arms form a pair of E-shaped lever arm subunits surrounding the roll.

5. The apparatus according to claim 1, wherein said actuators are pistion-cylinder actuators.

6. The apparatus according to claim 2, wherein said actuators are pistion-cylinder actuators.

7. The apparatus according to claim 1, wherein said compensating means further includes a pair of frame guide rollers mounted on said frame for supporting said flexible guide band.

8. The apparatus according to claim 7, wherein each said first lever arms are provided with a pair of spaced apart additional first lever arm guide rollers for further supporting and guiding the movement of the flexible guide roller.

* * * * *